US010422294B2

(12) United States Patent
Behrendt

(10) Patent No.: US 10,422,294 B2
(45) Date of Patent: Sep. 24, 2019

(54) METHOD FOR REGULATING A FUEL DELIVERY SYSTEM

(71) Applicant: CONTINENTAL AUTOMOTIVE GmbH, Hannover (DE)

(72) Inventor: Gerald Behrendt, Frankfurt am Main (DE)

(73) Assignee: Continental Automotive GmbH, Hannover (DE)

( * ) Notice: Subject to any disclaimer, the term of this patent is extended or adjusted under 35 U.S.C. 154(b) by 0 days.

(21) Appl. No.: 15/567,909

(22) PCT Filed: Apr. 25, 2016

(86) PCT No.: PCT/EP2016/059191
§ 371 (c)(1),
(2) Date: Oct. 19, 2017

(87) PCT Pub. No.: WO2016/173989
PCT Pub. Date: Nov. 3, 2016

(65) Prior Publication Data

US 2018/0135549 A1 May 17, 2018

(30) Foreign Application Priority Data

Apr. 27, 2015 (DE) ..... 10 2015 207 702

(51) Int. Cl.
*F02D 41/30* (2006.01)
*F02D 41/22* (2006.01)
(Continued)

(52) U.S. Cl.
CPC ..... *F02D 41/22* (2013.01); *F02D 41/26* (2013.01); *F02D 41/3082* (2013.01);
(Continued)

(58) Field of Classification Search
CPC ..... F02D 41/22; F02D 41/26; F02D 41/3082; F02D 41/221; F04B 49/065
(Continued)

(56) References Cited

U.S. PATENT DOCUMENTS 5,237,975 A 8/1993 Betki et al.
5,937,826 A * 8/1999 Olson ..... F02D 41/221 123/198 D
(Continued)

FOREIGN PATENT DOCUMENTS

DE 4446277 6/1996
DE 10 2009 050468 4/2011
(Continued)

OTHER PUBLICATIONS

Prof. Dr. Dr. Hanlang, Wolfgang A.; Prof. Dr.-Ing. habil. Konakovsky, Rudolf / Kurs 21661: Sicherheitsgerichte Echtzeitsysteme Oct. 2004.
(Continued)

*Primary Examiner* — Hai H Huynh
*Assistant Examiner* — Gonzalo Laguarda
(74) *Attorney, Agent, or Firm* — Cozen O'Connor

(57) ABSTRACT

A method for regulating a fuel delivery system without a pressure sensor. The fuel delivery system has a fuel delivery pump, an electric motor, and an evaluation unit. The fuel delivery pump is driven by the electric motor, which is actuated using control variables such that a prespecifiable fuel delivery is achieved. At least two different submethods are executed for ascertaining control variables, which are ascertained in the respective submethod and are supplied to an evaluation unit. The control variables are evaluated regarding their plausibility in the evaluation unit and the electric motor is actuated based on the ascertained control variables from only one or a plurality of submethods.

12 Claims, 3 Drawing Sheets

(51) Int. Cl.
*F02D 41/26* (2006.01)
*F04B 49/06* (2006.01)
*F02D 41/24* (2006.01)

(52) U.S. Cl.
CPC ..... *F04B 49/065* (2013.01); *F02D 41/2422* (2013.01); *F02D 41/2432* (2013.01); *F02D 2041/224* (2013.01); *F02D 2041/227* (2013.01); *F02D 2200/0604* (2013.01); *F02D 2250/31* (2013.01); *F04B 2203/0201* (2013.01)

(58) Field of Classification Search
USPC ..... 123/456, 457, 458, 495, 497, 498, 499, 123/510, 511; 73/114.41
See application file for complete search history.

(56) References Cited

U.S. PATENT DOCUMENTS 6,889,656 B1 * 5/2005 Rembold ..... F02D 41/062 123/446
8,988,025 B2 3/2015 Calnek et al.
9,127,611 B2 * 9/2015 Graf ..... F02D 41/221
9,587,579 B2 * 3/2017 Ulrey ..... F02D 41/3854
2005/0274362 A1 12/2005 Deraad
2012/0221226 A1 * 8/2012 Dolker ..... F02D 41/1401 701/103
2013/0187584 A1 * 7/2013 Calnek ..... H02P 6/08 318/400.21
2014/0105758 A1 4/2014 Sausner et al.
2017/0335788 A1 * 11/2017 Behrendt ..... F02D 41/3082
2018/0112620 A1 * 4/2018 Behrendt ..... F02D 41/3082
2018/0126844 A1 * 5/2018 Behrendt ..... B60K 15/077

FOREIGN PATENT DOCUMENTS

DE 102011015154 9/2012
DE 10 2013 200590 7/2013

OTHER PUBLICATIONS

Office Action dated Sep. 20, 2018 issued in Korean Patent Application No. 10-2017-7032989.
Office Action dated Feb. 21, 2019 issued in Korean Patent Application No. 10-2017-7032989.

* cited by examiner

METHOD FOR REGULATING A FUEL DELIVERY SYSTEM

CROSS REFERENCE TO RELATED APPLICATIONS

This is a U.S. national stage of application No. PCT/EP2016/059191, filed on Apr. 25, 2016. Priority is claimed on German Application No. DE102015207702.0, filed Apr. 27, 2015, the content of which is incorporated here by reference.

BACKGROUND OF THE INVENTION

1. Field of the Invention

The invention relates to a method for regulating a fuel delivery system without a pressure sensor, wherein the fuel delivery system has a fuel delivery pump, an electric motor, and an evaluation unit, wherein the fuel delivery pump can be driven by the electric motor and the electric motor can be actuated using control variables, and the electric motor can be actuated such that a prespecifiable fuel delivery is achieved.

2. Description of the Prior Art

The prior art discloses methods by way of which the pressure in a fuel delivery system can be ascertained without using a dedicated pressure sensor in the process. To this end, conclusions are drawn about the pressure prevailing in the fuel on the basis of known relationships between the rotation speed and the actuation current of a known fuel delivery pump in a known fuel delivery system. These methods are advantageous particularly for systems that do not have any additional pressure sensors and therefore have a relatively simple construction.

Within the scope of the methods, values for the rotation speed and the actuation current of a fuel delivery pump, which values are, for example, detected by sensors or read out from a controller, are compared with characteristic maps or characteristic curves stored in the controller, in order to draw conclusions about the pressure prevailing in the fuel for the respective fuel delivery system. As an alternative, the pressure in the fuel delivery system can also be set entirely by prespecifying or regulating the actuation current or the pump rotation speed. These methods are known as current-controlled or rotation speed-controlled methods.

One disadvantage of the prior art methods is, in particular, that they deliver results of different quality in each case depending on specific operating ranges of the fuel delivery system or of the motor vehicle. For example, disadvantageous situations can arise on account of a method which is not advantageous being used, depending on the driving state of the motor vehicle to which the delivery of fuel is intended to be ensured. In particular, severe deviations between the ascertained pressure values and the actually prevailing pressures can lead to undesired negative effects on the entire fuel delivery system here, as a result of which reliable and efficient operation of the internal combustion engine is also put at risk.

SUMMARY OF THE INVENTION

One object of the present invention is to provide a method that permits more accurate and more reliable determination of the pressure in a fuel delivery system and therefore more reliable regulation of the fuel delivery system, wherein, in particular, considerable independence of the different operating states of the fuel delivery system or of the motor vehicle is intended to be achieved. A further object of the invention is to provide an apparatus for operating the method.

One exemplary embodiment of the invention relates to a method for regulating a fuel delivery system without a pressure sensor, wherein the fuel delivery system has a fuel delivery pump, an electric motor, and an evaluation unit, wherein the fuel delivery pump can be driven by the electric motor and the electric motor can be actuated using control variables. The electric motor can be actuated in such a way that a prespecifiable fuel delivery is achieved. At least two different submethods are executed for ascertaining control variables and the control variables which are ascertained in the respective submethod are supplied to an evaluation unit. The control variables are evaluated in respect of their plausibility in the evaluation unit, and then the electric motor is actuated on the basis of the ascertained control variables from only one of the submethods or from a plurality of submethods.

The submethods are formed, in particular, from the different methods for ascertaining the pressure in a fuel delivery system or for ascertaining control variables for influencing fuel delivery.

One of the methods is characteristic map-based. In this case, a value for the pressure prevailing in the fuel delivery system is ascertained on the basis of known characteristic maps and the detection of individual state variables. The delivery rate of the fuel delivery system can then be adjusted on the basis of the ascertained pressure, as a result of which the pressure established in the fuel delivery system likewise changes.

Another method is distinguished in that it is current-controlled. Here, the current intensity is the relevant variable that is monitored and actively regulated. On account of the current with which the fuel delivery pump is actuated being prespecified, the rotation speed of the fuel delivery pump is automatically set depending on the other boundary conditions, such as the viscosity of the medium to be delivered.

A further method is volume-controlled regulation. Here, the pressure is detected or is ascertained from the relationship between current intensity and rotation speed and used in order to determine the respectively delivered volume. The pressure is therefore an auxiliary variable for calculating the delivered volume. The fuel delivery pump or the electric motor is then actuated in such a way that a prespecified delivery volume is achieved.

Other methods provide for comparison of the ascertained pressure value or the variables used for ascertaining the pressure value with characteristic variables from outside the fuel delivery system. Here, for example, vehicle models or other kinds of models can be stored in one of the controllers, these contributing to improving the calculation quality of the pressure value.

In addition to these methods, there are also further methods that can be used as a submethod in the method according to the invention in order to achieve a higher quality for the pressure value ascertaining operation or to configure the provision of the fuel by the fuel delivery pump according to the situation and requirements.

An evaluation unit can be a controller which is installed in the vehicle in a compact manner as a unit or is formed by networked individual components. The evaluation unit is particularly advantageously designed in such a way that it is able to detect and to compare the control variables supplied by different submethods and to assess the plausibility of said control variables in particular. This is particularly advantageous in order to ensure that the control variables supplied by the submethods are physically expedient and suitable for the current manner of operation or the operating state of the motor vehicle or the internal combustion engine supplied by the fuel delivery system. The different submethods have different properties and sensitivities and therefore supply control variables with different levels of accuracy for different operating states.

For example, in the case of a characteristic map-based submethod, a blocked fuel filter can lead to a reduction in the rotation speed of the fuel delivery pump since it is identified that the pressure is increasing while the throughflow rate remains low. However, reducing the rotation speed then leads specifically to continuously decreasing fuel delivery, as a result of which, in an extreme case, the delivery quantity is too low to ensure operation of the internal combustion engine. If a situation of this kind were to occur, for example, in the winter during cold starting of the vehicle, this could be due to a fuel filter which is clogged merely on account of the fuel being viscous. Here, instead of the above-described strategy, it would be more expedient to increase the supply of power to the fuel delivery pump or the electric motor and therefore increase the fuel delivery rate, as a result of which fuel is pushed through the filter. Owing to the delivery under increased pressure, the fuel heats up more quickly and normal operation of the motor vehicle can finally be ensured.

In order to avoid reducing the rotation speed, current-controlled regulation could be used for example, this being used with or without knowledge of the current operating situation, in order to ensure sufficient delivery of the fuel.

In the method according to the invention, it is particularly advantageous that a plurality of submethods, which each influence different values, are executed and, depending on the plausibility check, at least the control variables from one of the submethods are used. Depending on the design of the evaluation unit, said evaluation unit can advantageously refer to information about the motor vehicle or the internal combustion engine for selecting the control variables, in order to use the correct control variables for regulating the fuel delivery system according to the situation.

A plausibility check can involve, in particular, comparison of the control variables with expected control variables for specific operating states. This can also be done by comparison with a predefined value range. Further methods for checking the plausibility, such as comparison of control variables of two submethods with one another or comparison with control variables from the same submethod, can likewise be employed.

The evaluation unit is particularly advantageously designed such that the electric motor or the fuel delivery pump is actuated exclusively by the evaluation unit using the ascertained control variables of which the plausibility has been checked. The evaluation unit therefore determines which control variables are used in order to operate the fuel delivery system according to the situation and requirements.

It is also advantageous when the evaluation unit can also influence the individual control variables. In particular, weighting of the control variables that are further to be used, for example by amplification or attenuation, is advantageous in order to further improve the regulation of the fuel delivery system.

It is also preferred when the submethods are executed in parallel and/or in series. A parallel application is particularly expedient in order to acquire the respective control variables of the individual submethods and to be able to perform an evaluation at the same time. A series application is particularly advantageous in order to possibly use the control variables ascertained in one submethod in another submethod too, in order to increase the accuracy and increase the quality of the control variables ultimately passed to the electric motor.

Furthermore, it is advantageous when the plausibility of the control variables is evaluated with the aid of external state variables, wherein the external state variables serve to determine a current operating state, wherein limit values for the control variables are derived from the operating state that is currently established.

External state variables are, in particular, state variables from other controllers and sensors from the motor vehicle. These can be used to detect the current operating state of the motor vehicle. Limit values, which limit the output of the control variables in order to avoid damage for example, can be associated with the respectively detected operating states. Special expected values, which can be used for checking the plausibility of the control variables ascertained by the submethods, can also be linked with the operating states.

Furthermore, it is advantageous when an emergency program is started in the event of an implausibility of the control values, which is established in the evaluation unit.

An emergency program is characterized, in particular, by characteristic map-based actuation that only allows functioning of the internal combustion engine within certain defined limits. This can advantageously be triggered when the control variables supplied by the submethods are implausible such that a serious fault has to be assumed.

An implausibility can be, for example, a deviation by a predefined expected value once or several times or overshooting of a defined limit value.

It is also expedient when an operating mode for the fuel delivery system is defined by the evaluation unit, wherein control variables are used in each operating mode, which control variables have been ascertained on the basis of, in each case, only one submethod or which control variables have been ascertained on the basis of at least two submethods.

This is advantageous in order to ensure that overall control over the decision of how the fuel delivery system should be operated is central in a unit. Owing to a contribution of the different control variables of the submethods, the evaluation unit is supplied with enough information to make an expedient choice regarding the operation of the fuel delivery system. An expedient choice is distinguished, in particular, by efficient operation and actuation of the electric motor according to requirements. Control variables from only one submethod or else from more than one submethod can be used, depending on which operating mode is chosen by the evaluation unit.

Furthermore, it is advantageous when a selection regarding the submethod to be used is made in the evaluation unit with the aid of external state variables.

External state variables are formed, for example, by measurement values of other controllers or values detected by sensors. These preferably allow a statement to be made about the current operating state of the vehicle. Owing to this additional information, the operation of the fuel delivery system can be further improved and, in particular, a submethod that is suitable for the operating state can be selected.

Furthermore, it is expedient when a calibration unit can be activated by the evaluation unit, wherein the calibration unit is associated with one of the submethods and is designed to calibrate the respective submethod.

A dedicated calibration unit is particularly advantageously associated with each submethod. The calibration unit can be represented in other controllers or can be designed in a dedicated manner for each of the submethods. The calibration unit serves, in particular, for calibrating the individual values which are detected, calculated or used in some other way within the submethod. Owing to a calibration, temperature influences or changes in the physical properties of the fuel, for example, can be compensated for in order to achieve a higher degree of accuracy.

It is particularly advantageous when the submethods use external state variables as input variables and ascertain output variables therefrom, wherein the output variables of one submethod can be used as input variables of another submethod. This is particularly advantageous since coupling between the individual submethods, which leads to a higher regulation quality, can be created in this way. In particular, this can result in control variables being repeatedly passed back and forth between submethods, wherein the quality of the control variable is continuously increased.

For example, in one submethod, a limit for a minimum delivery quantity and a limit for a maximum delivery quantity can be ascertained, these limits necessarily having to be complied with in order to achieve a desired target pressure. In another submethod, the respectively required rotation speed for achieving the respective delivery quantity at the desired target pressure can be ascertained from the maximum values and minimum values. This rotation speed, for its part, can be fed to the first submethod again for ascertaining the minimum and maximum delivery quantity, as a result of which an improvement in the quality of the control variable ultimately produced is achieved overall.

It is also advantageous when the method is repeatedly applied to ensure continuous regulation of fuel delivery by the fuel delivery system. In particular, execution of the method in a control loop is advantageous since continuous regulation of the fuel delivery system is made possible in this way.

One exemplary embodiment of the invention relates to an apparatus for application of a method for regulating the fuel delivery system, wherein the fuel delivery system has at least one evaluation unit, at least one calibration unit and at least one data memory.

It is particularly advantageous when the evaluation unit also provides the computational capacity and the structure for executing the submethods. This can be performed in one dedicated structural unit or by networked individual elements. The data memory and the calibration unit can likewise be formed in one structural unit with the evaluation unit. The data memory is advantageous particularly for buffer storing values and also for storing errors or faults that can occur during execution of the method according to the invention. The values stored in the data memory can be permanently or only temporarily retained.

Advantageous developments of the present invention are described in the dependent claims and in the following description of the figures.

BRIEF DESCRIPTION OF THE DRAWINGS

The invention is explained in greater detail below using exemplary embodiments with reference to the drawings, in which.

DETAILED DESCRIPTION OF THE PRESENTLY PREFERRED EMBODIMENT

Figure 1:
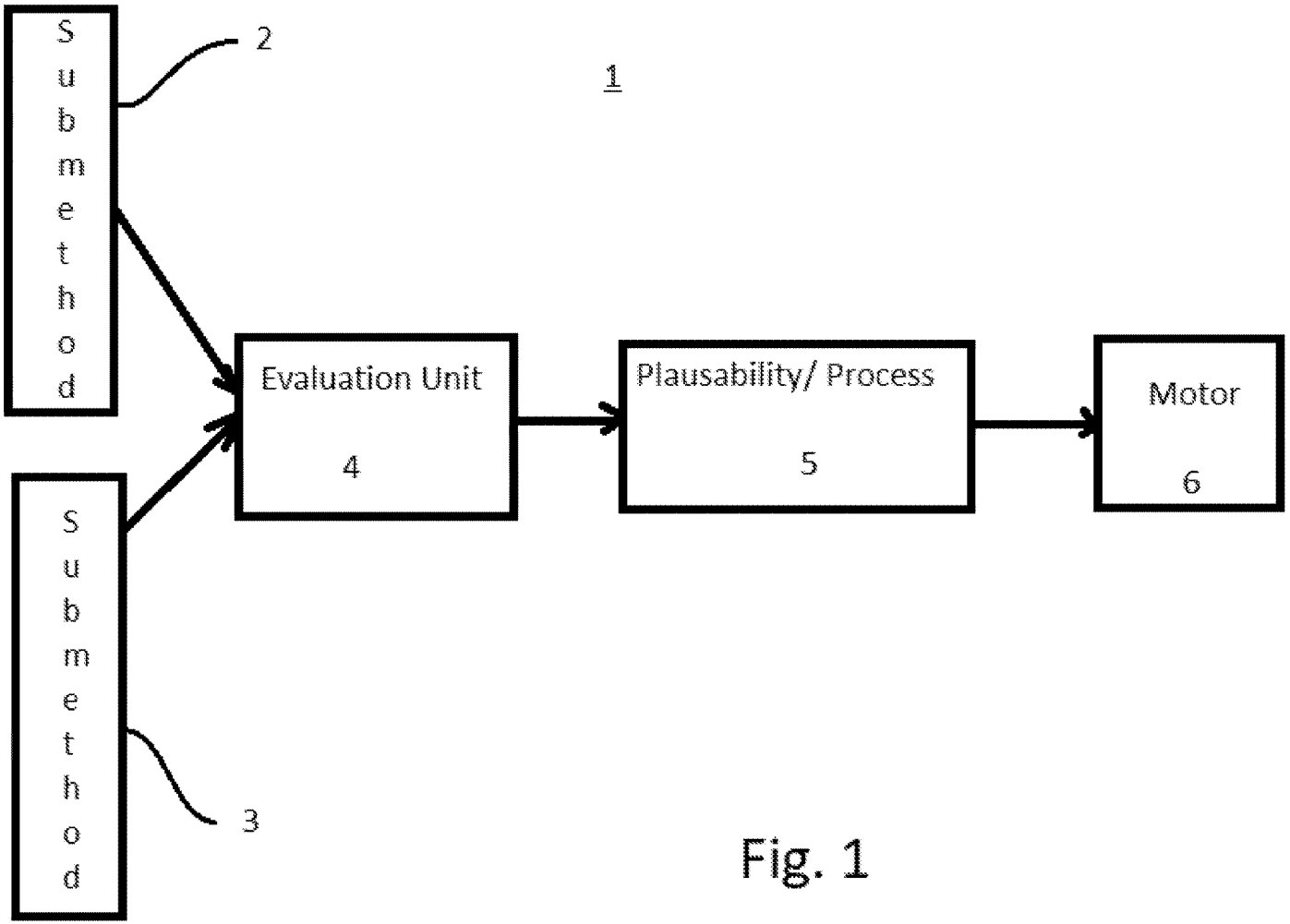
FIG. 1 is a flowchart that illustrates the method according to one aspect of the invention.

FIG. 1 is a flowchart 1 that illustrates the method according to one aspect of the invention in a schematic drawing. The blocks 2 and 3 respectively symbolize one of the submethods applied during the method. Control variables are ascertained from the submethods 2 and 3 and passed on to an evaluation unit. This is illustrated by the block 4. In the evaluation unit, the control variables are checked regarding their plausibility and possibly processed further. This is illustrated by the block 5. Finally, control variables that are processed and possibly weighted by the evaluation unit are passed on to the electric motor 6. The electric motor 6 is actuated by the control variables such that prespecified fuel delivery by the fuel delivery pump is achieved. The method illustrated in FIG. 1 can be repeated in a control loop to ensure continuous adjustment of the work of the electric motor 6 and to provide fuel delivery in as optimum a manner as possible.

Figure 2:
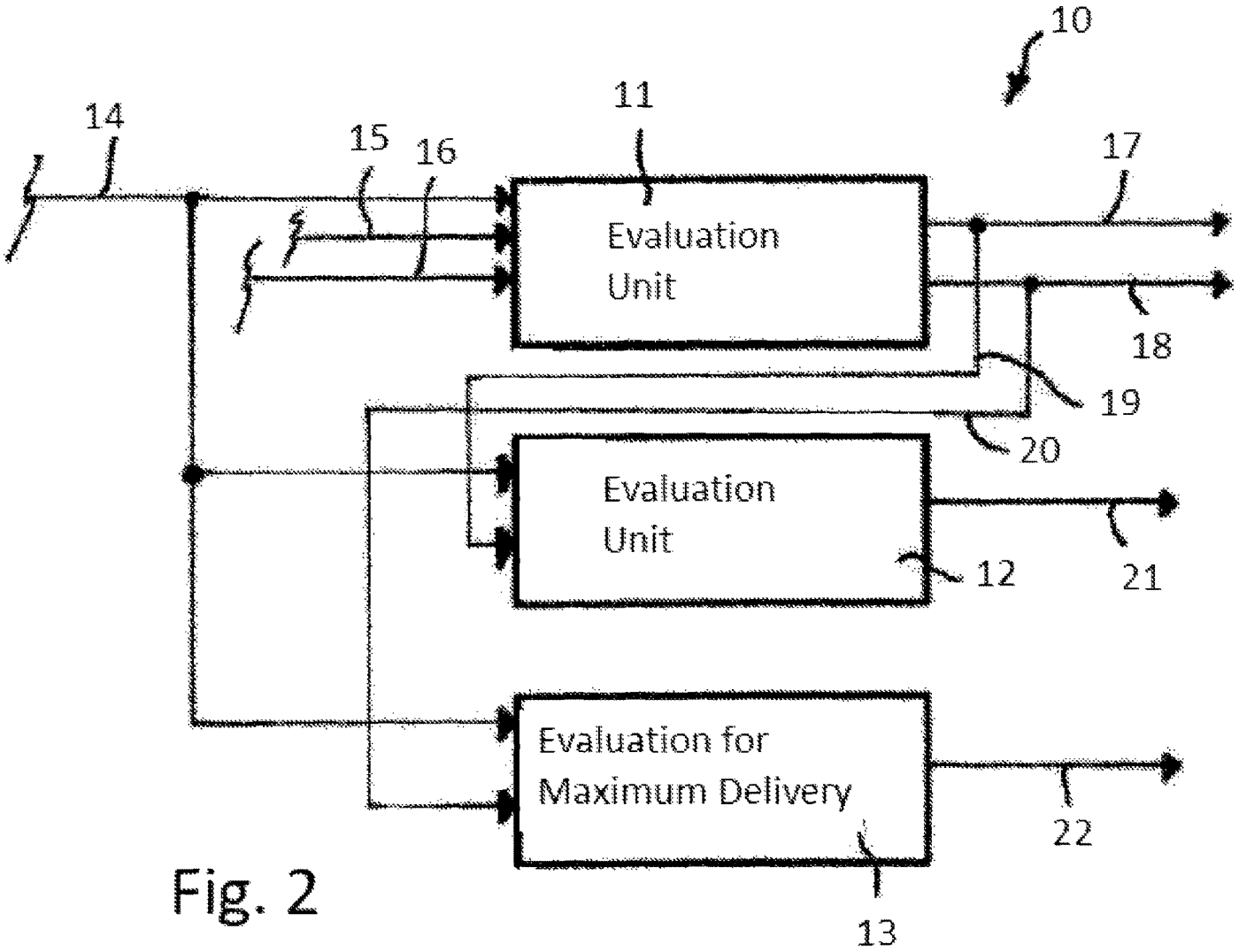
FIG. 2 is an exemplary illustration for coupling two submethods to one another.

FIG. 2 shows, in the block diagram 10, an example of how submethods can be combined with one another. A volume-regulated method that receives different input variables 14, 15, and 16 and processes them to form the output variables 17 and 18 is implemented in the block 11. In the present example, the input variable 14 is a calculated pressure value for the pressure in the fuel delivery system. The input variable 15 corresponds to the current currently applied to the electric motor of the fuel delivery system. The input variable 16 is formed by the rotation speed of the fuel delivery pump or of the electric motor.

Limit values for the volume that can be delivered are ascertained from the input variables in the submethod formed by the block 11. The output variable 17 represents the minimum delivery volume, while the output variable 18 represents the maximum delivery volume.

The two output variables 17, 18 are firstly processed further in downstream units, such as the evaluation unit for example, and secondly also routed along the signal lines 19, 20 to the blocks 12, 13, as illustrated in FIG. 2. The output variables 17, 18 of the block 11 therefore form input variables for the blocks 12 and 13. In addition, the input variable 14 is also supplied to the blocks 12, 13. A conclusion can be drawn from the minimum and the maximum delivery volume, with the inclusion of the input variable 14, which reflects the calculated pressure value in the fuel delivery system, about a respectively required rotation speed of the electric motor or of the fuel delivery pump in order to be able to deliver the respective delivery volume.

The result for the rotation speed for achieving the minimum delivery volume is output from block 12 as output variable 21. The rotation speed for achieving the maximum delivery volume is output as output variable 22 from block 13.

FIG. 2 shows only a single exemplary illustration of an interconnection of individual submethods with one another. This is intended to illustrate the principle that individual submethods can be combined in series with one another or in parallel with one another in such a way that, by including additional control variables from other submethods, the quality of the ascertained control variables can be increased overall.

Figure 3:
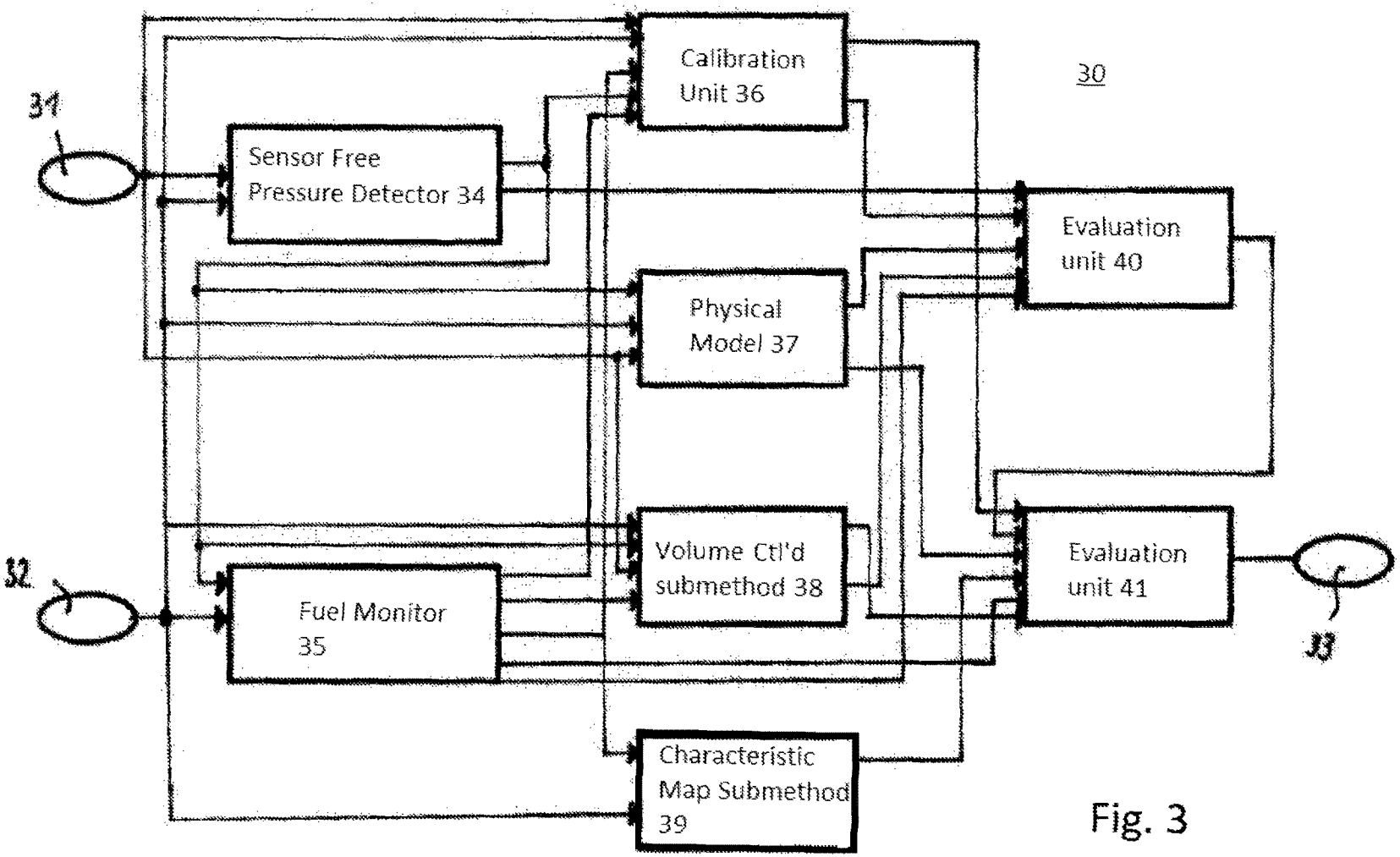
FIG. 3 is an exemplary illustration of a system for executing the method according to one aspect of the invention.

FIG. 3 shows a further block diagram 30. A plurality of blocks 34, 35, 36, 37, 38, 39, 40, and 41, which respectively correspond to individual submethods, to an evaluation unit or to a calibration unit, are illustrated in the block diagram 30. A large number of signal lines, which show how the individual submethods and units can be networked with one another, are illustrated between the blocks 34 to 41. The illustration of the block diagram 30 is merely exemplary and is not of a limiting nature, particularly in respect of the number of submethods used or the interconnection of the submethods with one another.

Input variables are supplied to the system shown by the blocks 31 and 32, and an output variable is drawn by the block 33 and then passed to the electric motor.

Block 34 represents a sensor-free pressure detection operation that draws conclusions about the pressure in the fuel delivery system from measurement values. To this end, the rotation speed of the fuel delivery pump and the current intensity applied to the electric motor can be used for example. The submethod 34 draws the required input variables by the block 31.

The block 35 represents a fuel monitoring operation in the example of FIG. 3. Measurement values from the block 32 and the pressure ascertained in the block 34 are input into the fuel delivery system as input variables. In particular, external state variables, which allow a statement to be made about the operating state of the motor vehicle and the environmental conditions of said motor vehicle, are supplied to the block 35 from block 32. The output variables from block 35 include, in particular, a volume signal, which reflects the quantity of fuel required, and a demand signal, which can be sent to the fuel delivery system or the fuel delivery pump as a request.

The block 36 forms a calibration unit. The calibration unit serves to calibrate the values and signals detected by it, in order to eliminate undesired influences and inaccuracies. Examples of the input variables of the calibration unit are the data from the fuel delivery pump from block 31, the external state variables from block 32, the volume signal from block 35 and the ascertained pressure from block 34. These values can be calibrated in accordance with the stored calibration mechanisms. From block 36, the calibrated values can be passed on to downstream submethods.

Block 37 represents a physical model which outputs, in particular, rotation speed prespecifications and rotation speed demands on the basis of a plurality of input variables. The input variables include the pressure ascertained in the block 34, the external state variables from block 32 and the data relating to the fuel delivery pump originating from block 31.

Block 38 forms a volume-controlled submethod. It uses, for example, the external state variables from block 32, the data relating to the fuel delivery pump 31 and also the pressure ascertained in block 34 as input variables. An output variable is, for example, a rotation speed demand in order to achieve or maintain the desired delivery volume.

The block 39 represents a characteristic map-based submethod. It receives a pressure value and a volume variable as input variables. A rotation speed is output as output variable from said input variables based on the fuel volume required.

The output variables of the blocks 34 to 39 are supplied, amongst others, to the blocks 40 and 41. The block 40 forms an evaluation unit which monitors the input variables passed to it, in order to identify any deviations and implausibilities which may arise and to trigger an emergency program if required.

Block 41 likewise forms an evaluation unit which finally assesses and possibly weights the generated signals, which are passed to the block 41 in the form of input variables, before selected signals are output to the block 33. A final control signal is output to the block 33. This control signal is generated on the basis of the output variables or control signals generated by the submethods in the various blocks 34 to 39, and represents a control command for the electric motor of the fuel delivery pump.

In one advantageous refinement, the blocks 40 and 41 can together also form a common evaluation unit which contains all of the functionalities of the two blocks 40, 41.

The method shown in the block diagram 30 can be repeatedly implemented in any desired number of loops in order to ensure continuous regulation of the electric motor or the fuel delivery pump. The block diagram 30 is merely exemplary and is highly simplified. It serves to support the concept of the invention and expressly is not of a limiting nature.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A method for regulating a fuel delivery system without a pressure sensor, wherein the fuel delivery system has a fuel delivery pump, an electric motor that drives the fuel delivery pump, and an evaluation unit, wherein the electric motor is actuated using control variables such that a prespecifiable fuel delivery is achieved, comprising: executing at least two different submethods, each using different values, to ascertain respective control variables to control the fuel delivery pump; supplying the control variables which are ascertained to an evaluation unit; evaluating the control variables regarding their plausibility in the evaluation unit; and actuating the electric motor based at least in part on the ascertained control variables from only one of the at least two different submethods.

2. The method as claimed in claim 1, wherein the submethods are executed at least one of in parallel and in series.

3. The method as claimed in claim 1, further comprising:

evaluating the plausibility of the control variables with aid of external state variables;

determining a current operating state based at least in part on the external state variables; and deriving limit values for the control variables from the current operating state that is currently established.

4. The method as claimed in claim 1, further comprising:

starting an emergency program in event of an implausibility of values of the control variables established in the evaluation unit.

5. The method as claimed in claim 1, further comprising:

defining an operating mode for the fuel delivery system by the evaluation unit;

wherein control variables, which have been ascertained based on in each case only one submethod or which control variables have been ascertained based on at least two submethods, are used in each operating mode.

6. The method as claimed in claim 1, wherein a selection regarding the submethod to be used is made in the evaluation unit based at least in part on external state variables.

7. The method as claimed in claim 1, further comprising:

activating a calibration unit by the evaluation unit, wherein the calibration unit is associated with one of the submethods and is configured to calibrate the respective submethod.

8. The method as claimed in claim 1, wherein the submethods use external state variables as input variables and ascertain output variables therefrom, wherein the output variables of one submethod can be used as input variables of another submethod.

9. The method as claimed in one claim 1, wherein the method is repeatedly applied to ensure continuous regulation of the fuel delivery by the fuel delivery system.

10. The method as claimed in claim 1, wherein the at least two different submethods each influence different values.

11. The method as claimed in claim 1, wherein the at least two different submethods ascertain respective control variables with different levels of accuracy.

12. An apparatus configured to regulating a fuel delivery system without a pressure sensor, comprising: at least one evaluation unit configured to: receive respective control variables which are ascertained from at least two different submethods, each submethod using different values, to ascertain respective control variables to control the fuel delivery pump; and evaluate the control variables regarding their plausibility; a fuel delivery pump; an electric motor that drives the fuel delivery pump, wherein the electric motor is actuated using control variables such that a prespecifiable fuel delivery is achieved, the control variables ascertained from only one submethod; at least one calibration unit; and at least one data memory.

* * * * *